US008770136B2

(12) United States Patent
Larson

(10) Patent No.: US 8,770,136 B2
(45) Date of Patent: Jul. 8, 2014

(54) RETRACTABLE BOAT COVER ASSEMBLY

(76) Inventor: Jeffrey Larson, Loves Park, IL (US)

( * ) Notice: Subject to any disclaimer, the term of this patent is extended or adjusted under 35 U.S.C. 154(b) by 384 days.

(21) Appl. No.: 13/274,086

(22) Filed: Oct. 14, 2011

(65) Prior Publication Data

US 2013/0092072 A1 Apr. 18, 2013

(51) Int. Cl.

| | |
|---|---|
| ***B63B 17/02*** | (2006.01) |
| ***B63B 19/14*** | (2006.01) |
| ***B63B 19/18*** | (2006.01) |
| ***B63B 19/21*** | (2006.01) |

(52) U.S. Cl.

USPC ..... 114/361; 141/202

(58) Field of Classification Search

USPC ..... 114/201 R, 202, 361; 49/197–206; 160/84.06, 108–111, 118, 133, 201, 160/202, 214, 270–272; 296/98, 296/100.11–100.14, 136.01, 136.03, 219

See application file for complete search history.

(56) References Cited

U.S. PATENT DOCUMENTS

| | | | | |
|---|---|---|---|---|
| 2,547,196 | A * | 4/1951 | Clark | 160/189 |
| 3,307,566 | A | 3/1967 | Hale | |
| 3,312,990 | A | 4/1967 | Lapworth | |
| 3,463,111 | A * | 8/1969 | Paul et al. | 114/202 |
| 3,586,365 | A * | 6/1971 | Dickson et al. | 296/100.12 |
| 3,756,650 | A * | 9/1973 | Michel | 296/100.12 |
| 4,285,539 | A * | 8/1981 | Cole | 296/105 |
| 4,641,600 | A | 2/1987 | Halvorsen | |
| 4,976,302 | A * | 12/1990 | Taylor | 160/310 |
| 5,016,558 | A | 5/1991 | Oehler | |
| 5,303,667 | A | 4/1994 | Zirkelbach et al. | |
| 5,479,872 | A | 1/1996 | Hulett | |
| 5,706,752 | A | 1/1998 | Menne, Jr. et al. | |
| 5,803,104 | A | 9/1998 | Pollen | |
| 6,006,692 | A | 12/1999 | Szukhent, Jr. | |
| 6,158,377 | A | 12/2000 | Szukhent, Jr. | |
| 6,263,825 | B1 | 7/2001 | Davidson | |
| 6,349,666 | B1 | 2/2002 | Hastings | |
| 6,439,150 | B1 | 8/2002 | Murphy et al. | |
| 6,637,364 | B1 | 10/2003 | Campeau | |
| 6,820,569 | B2 | 11/2004 | Warfel et al. | |

* cited by examiner

*Primary Examiner* — Ajay Vasudeva
(74) *Attorney, Agent, or Firm* — Vedder Price PC

(57) ABSTRACT

A cover assembly for use to protect the contents of a boat including a pair of channels, a semi-rigid guide member slidably disposed within a passage of one of the channels, a crossrod supported on each end by one of the pair of channels and connected on one end to the semi-rigid guide member, and a cover sheet connected to the crossrod. The cover assembly configured such that as a retraction mechanism moves the semi-rigid guide member in the passage, the cover is extended or retracted to the desired position.

14 Claims, 4 Drawing Sheets

RETRACTABLE BOAT COVER ASSEMBLY

The present disclosure is related to boat cover assemblies that provide an aesthetically pleasing appearance and enable the user to easily cover and uncover a boat while also providing a means for storing the cover when not in use.

BACKGROUND

Boats are used in environments in which the contents of the boat are subjected to moisture and other conditions that can have a detrimental effect on their durability and longevity. Covers are often used during use and non-use in order to protect the boat's contents. Long-term exposure to moisture and sunlight can have detrimental effects such as premature failure, material degradation, and fading that affects many of the materials that are used to make the contents of a boat. A boat may contain a variety of things including interior seating, boat controls, recreational equipment, fishing supplies, electronic devices, infrastructure components, and others. All of these items benefit from being covered to reduce their exposure to environmental conditions.

Covers for boats, especially recreational boats, are typically a large piece of material such as canvas that is placed over open areas of a boat and secured directly to the boat's structure via snaps or other fastening devices. The process for covering a boat and securing the cover in place can be a time consuming process. The cover itself can be a heavy item and it must be lifted and positioned in its proper orientation. Further, the fasteners must be oriented in the correct configuration to line-up with the corresponding fasteners on the boat's structure. Each time a recreational boat is used, the user must typically remove the cover, store it in a remote location and then re-install the cover when the user returns. This uncovering, storing, and recovering process each time a boat user uses a boat is undesirable because of the effort and time involved but is necessary to prolong the life and value of the boat and its contents. Therefore, a new cover is needed to reduce the effort and time associated with covering, storing and uncovering a boat.

BRIEF DESCRIPTION OF THE DRAWINGS

The following disclosure as a whole may be best understood by reference to the provided detailed description when read in conjunction with the accompanying drawings, drawing description, abstract, background, and associated headings. Identical reference numerals when found on different figures identify the same elements or a functionally equivalent element. The elements listed in the abstract are not referenced but nevertheless refer by association to the elements of the detailed description and associated disclosure.

SUMMARY

In one aspect of the present disclosure, a cover assembly may include a first channel having a passage and a second channel having a passage. The cover assembly may further include a semi-rigid guide member slidably disposed with the first passage and a crossrod with a first end and a second end. The first end of the cross rod is connected to the semi-rigid guide member. Movement of the semi-rigid guide member causes movement of the crossrod. The cover assembly may further include a cover sheet attached to the crossrod and a retraction mechanism that is adapted to move the semi-rigid guide member through the passage.

DETAILED DESCRIPTION

The present disclosure is not limited to the particular details of the apparatus depicted, and other modifications and applications may be contemplated. Further changes may be made in the apparatus, device or methods without departing from the true spirit of the scope of the disclosure herein involved. It is intended, therefore, that the subject matter in this disclosure should be interpreted as illustrative, not in a limiting sense.

Figure 1:
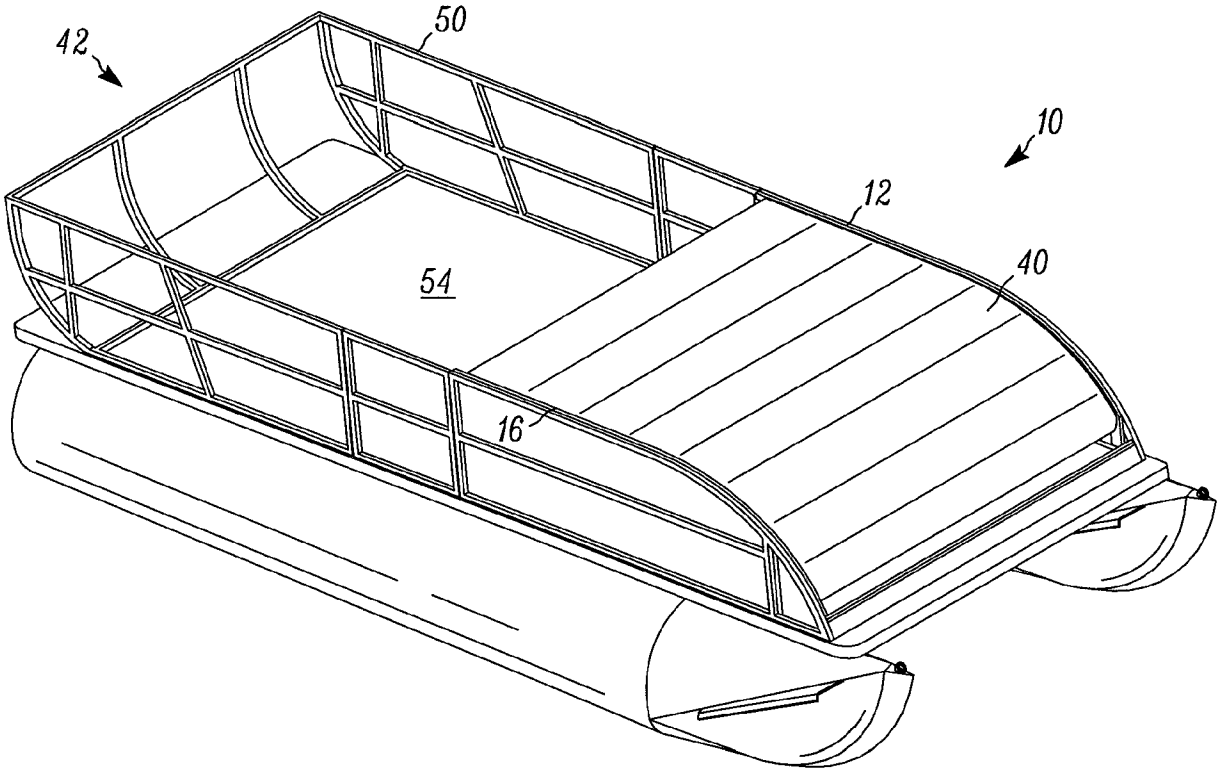
FIG. 1 is an illustration of a boat with a cover assembly according to an example of the present disclosure.

In one example, a boat 42 as shown in FIG. 1 has a cover assembly 10. The boat 42 includes a deck 54 and a frame structure 50. Boat 42 as shown in FIG. 1 is a pontoon-type boat but the structure and characteristics as disclosed can be applied to a variety of boats and vehicles as would be known to one of ordinary skill in the art. Cover assembly 10 includes a cover sheet 40 and a pair of channels 12, 16 running along the length of boat 42. The pair of channels 12, 16 are spaced apart at a predetermined distance so that the support system for cover sheet 40 fits and interacts with the pair of channels 12, 16 as will be explained.

Figure 2:
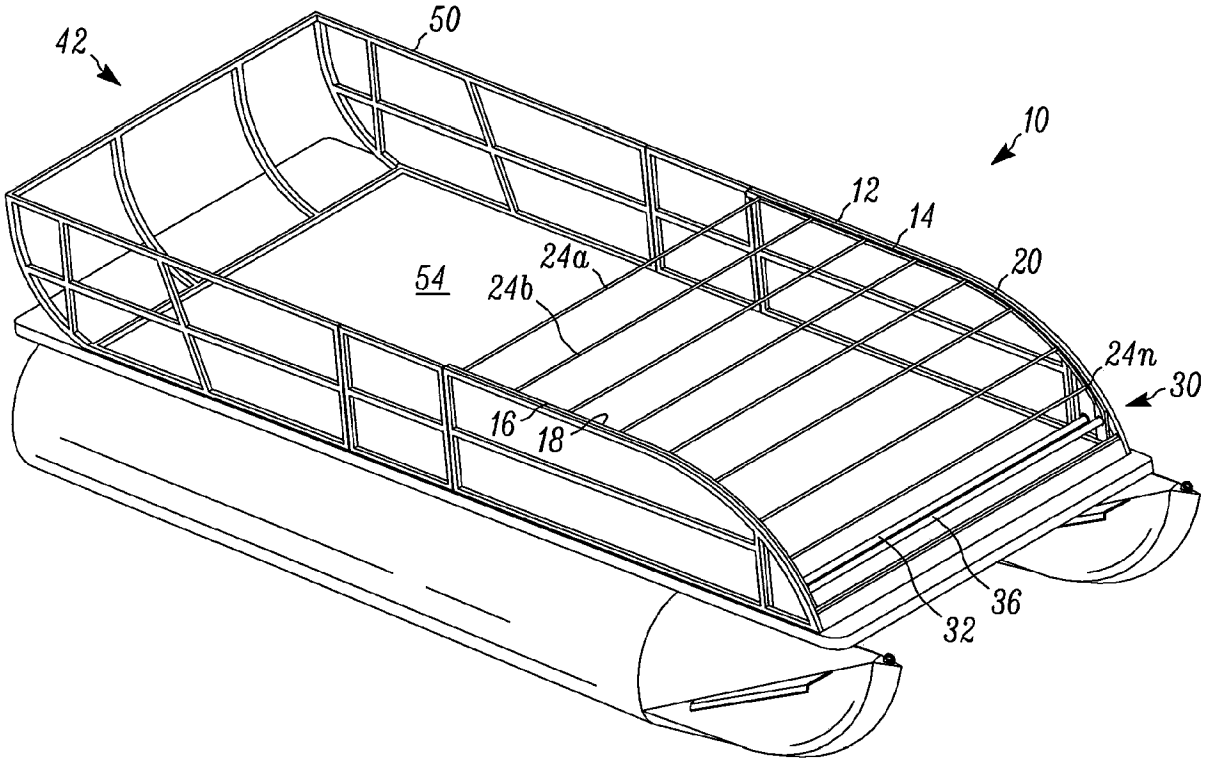
FIG. 2 is an illustration of the boat cover assembly of FIG. 1 with the cover sheet removed.

In this example, FIG. 2 shows the cover assembly 10 without the cover sheet 40 so that the support system and other components of cover assembly 10 can be seen. Cover assembly 10 further includes multiple crossrods 24*a*, 24*b* . . . 24*n* that span between the pair of channels 12, 16 and are situated in a manner so as to provide support to cover sheet 40 when the cover assembly 10 is in the extended position. Cover assembly 10 also has a semi-rigid guide member 20 and a retraction mechanism 30 that will be explained further below.

Figure 3:
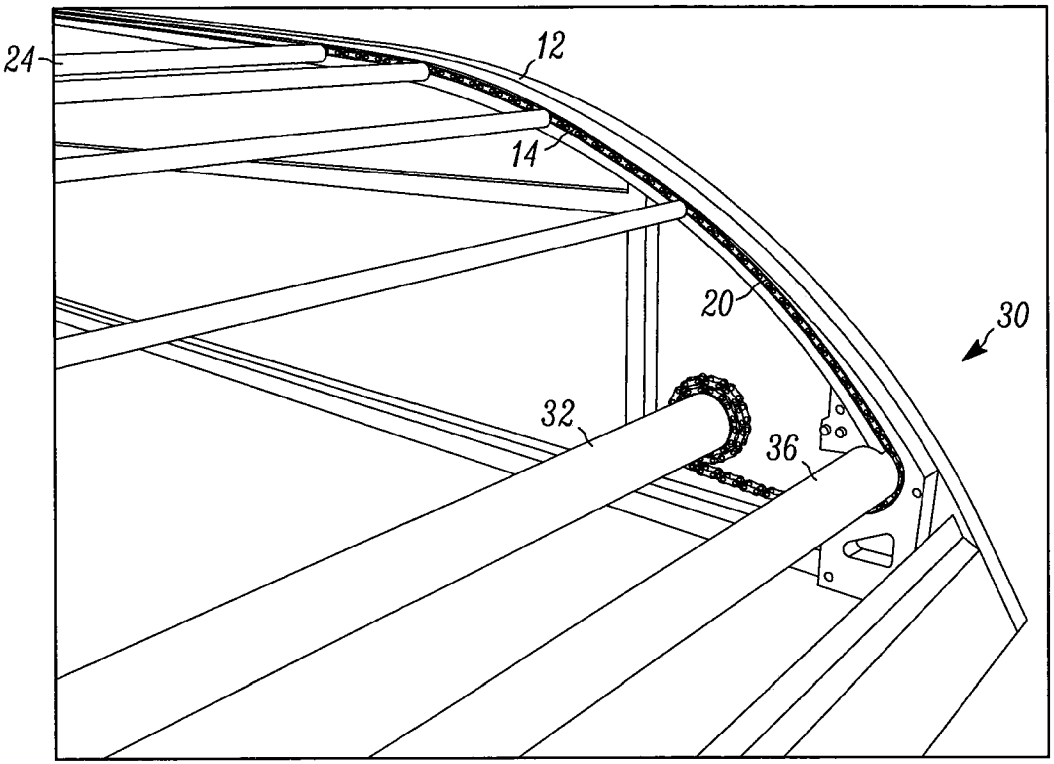
FIG. 3 is a close-up illustration of the retraction mechanism of the cover assembly according to an example of the present disclosure.

As seen in FIG. 2 and FIG. 3, in this example, each of the pair of channels 12, 16 has a passage 14, 18 that runs along the length of each channel. Located within the passage 14 is semi-rigid guide member 20. Semi-rigid guide member 20 is a component that facilitates the movement of the cover assembly from an extended position to a retracted position as will be explained. The semi-rigid guide member 20 as shown in this example is a stainless steel chain. The chain is a typical hollow pin roller chain known to those of ordinary skill in the art. As such, the chain has link plates that are connected together via hollow pins. In between the link plates and assembled over the pins are rollers. The semi-rigid guide member 20 is a stainless steel chain in this example but other materials or structures can be used. A different type chain could be used such as a conveyor chain and other materials could be used such as a carbon steel chain with a corrosion-resistant coating. A structure different than a chain could be used as well. The semi-rigid guide member can be any semi-flexible member that is able to impart forces in multiple directions to the other components of cover assembly 10 and facilitate the extension and retraction of cover assembly 10 is contemplated.

Figure 4:
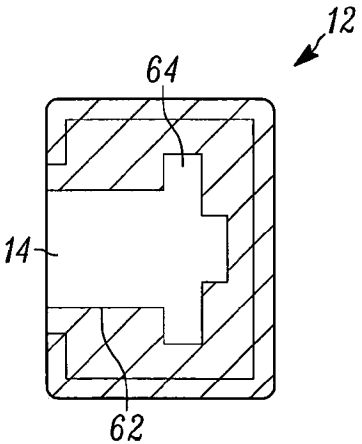
FIG. 4 is an illustration of the cross-section of the channel according to an example of the present disclosure.

The pair of channels 12, 16 in this example have a configuration to facilitate the retention and force transmission of semi-rigid guide member 20. A cross-section of first channel 12 is shown in FIG. 4. The cross-section shows that first channel 12 has a passage 14. Passage 14 has a unique configuration including roller surface 62 and link plate opening 64. Roller surface 62 and link plate opening 64 are sized such that the semi-rigid guide member 20 or chain of this example, fits within passage 14. The roller of the chain rides on roller surface 62 and the link plate of the chain fits inside the link plate opening 64. The configuration of roller surface 62 and link plate opening 64 is configured so that the chain is retained within channel 12 as the chain moves longitudinally down channel 12 or in a direction in and out of the page as seen in FIG. 4. Channel 12 is further sized such that the link plate opposite the link plate that is retained within channel 12 is exposed as seen in FIG. 3. Channels 12, 16 can be constructed from a variety of materials but in this example, the channels are constructed from UHMW polyethylene. The channels may also be constructed from nylon or acetal. The channels are preferably constructed from materials with low-friction properties or low-friction coatings. Channels 12, 16 may also have a metal shell to provide additional protection and support to the inner channel material.

The exposed link plate of the chain facilitates attachment of crossrods 24 to semi-rigid guide member 20. In this example, each crossrod 24 is attached to the chain by a fastener such as a screw inserted through the hollow pin of the chain and into an end of crossrod 24. As can be appreciated, this connection results in a configuration in which movement of semi-rigid guide member 20, or the chain in this example, results in movement of crossrods 24. The cover sheet 40 is connected to the crossrods 24. In this example, cover sheet 40 has additional pieces of material sewn or otherwise attached to cover sheet 40 that create pockets in which crossrods 24 are positioned. Other methods of attaching crossrods 24 to cover sheet 40 may include straps, rivets, adhesive, or other mechanical fasteners. As can be appreciated, by this structure, as the semi-rigid guide member 20 slides in channel 12, the crossrods 24 and the cover sheet 40 also move and facilitate the extension or retraction of cover assembly 10.

Cover assembly 10 also includes retraction mechanism 30. In this example, retraction mechanism 30 includes drive member 36 and coil member 32. The drive member 36 interacts with the semi-rigid guide member 20 as it exits the passage 14 of channel 12. Drive member 36 is a cylindrical hollow component that transversely spans the width of boat 42 and is connected between the transverse sides of frame structure 50 as shown in FIG. 2. The connection allows drive member 36 to rotate about its center axis. Drive member 36, in this example, is made from aluminum hollow tubing but other materials are contemplated such as PVC plastic or coated steel. At the end of drive member 36 where the semi-rigid guide member 20 exits the passage 14 of channel 12, the cylindrical base component of drive member 36 includes a sprocket for engaging the semi-rigid guide member 20 or a chain in this example. The sprocket of drive member 36 is able to move semi-rigid guide member 20 in and out of the passage 14 of channel 12 by rotation of the drive member 36 and interaction of the sprocket with the chain as explained. Drive member 36 may also have a different configuration other than a chain and sprocket as is known by one of ordinary skill in the art so long as the drive member 36 interacts with semi-rigid guide member 20 to impart movement to the semi-rigid guide member and facilitate the extension or retraction of cover assembly 10.

In other examples, drive member 36 is coupled to a motor. The motor is housed proximately to drive member 36 and coupled to drive member 36 by various methods. The motor may be coupled to drive member 36 via any suitable means but a belt, a chain or a worm gear are contemplated. As the motor is engaged, it causes drive member 36 to rotate and cause cover assembly 10 to extend or retract depending on the needs of the user. A variety of types of motors can be used such as AC, DC, brushed, brushless, stepper, or servo or other types as known to those of ordinary skill in the art. A remote actuation mechanism and control module may also be connected to the motor to control the movement, speed, and operation of the motor and thus operation of the cover assembly 10. Also contemplated is a configuration where instead of a motor, the drive member 36 is attached to a crank, wheel or other device capable of manually causing drive member 36 to rotate. Manual rotation of the crank, wheel or other rotation device would extend or retract the cover as desired.

Also in this example, retraction mechanism 30 includes coil member 32. Coil member 32 is also a cylindrical hollow component that spans transversely between the sides of frame structure 50 and is able to rotate about its center axis. The length of semi-rigid guide member 20 that is not located within channel 12 exits the channel and is coiled around coil member 32 as shown in FIG. 3. As discussed earlier, crossrods 24 are connected to cover sheet 40 and to semi-rigid guide member 20. As the length of semi-rigid guide member 20 coils around coil member 32, crossrods 24 and cover sheet 40 also wrap around coil member 32 so that the cover sheet 40 and associated crossrods 24 are stored when cover assembly 10 is in a retracted position.

Coil member 32 can be made of similar materials as discussed regarding the construction of drive member 36. Coil member 32 also may include a torsion spring that biases the rotation of coil member 32 for clockwise rotation as it is situated in FIG. 3. Bias of coil member 32 by a torsion spring will cause coil member 32 to rotate as drive member 36 moves a length of semi-rigid guide member 20 out of channel 12 and to wrap the semi-rigid guide member 20, crossrods 24, and cover sheet 40 around coil member 32 as slack is created. In an opposite mode, drive member 36 is able to overcome the bias of the torsion spring of coil member 32 and move a length of semi-rigid guide member 20 into channel 12 and cause the semi-rigid guide member 20, crossrods 24, and cover sheet 40 to unwrap from coil member 32 as coil member 32 rotates. The torsion spring of coil member 32 is any suitable type known to one of ordinary skill in the art. In this example, a plain steel, 32-inch long, 0.250 wire diameter torsion spring is used.

The second channel 16 may have a similar configuration as that of first channel 12. Second channel 16 may have a passage, roller surface, and link plate opening as described and include a second semi-rigid guide member as shown in FIG. 2. Crossrods 24 may also be connected to the second semi-rigid guide member via a fastener through a hollow pin of the second semi-rigid guide member. The coil member 32 and drive member 36 of retraction mechanism 30 also may interact with the second semi-rigid guide member as previously explained.

Operation of cover assembly 10 can be accomplished in many different ways. In one example, the cover assembly 10 is operated manually. In this example, a user desiring to extend cover assembly 10 would grab one of crossrods 24 while standing on boat 42. The user would pull the crossrod 24 rearward. As a result of the user pulling on the crossrod 24, a coil member 32 would rotate, the semi-rigid guide member would move into the passage of the channel and the crossrods would move along with the attached cover sheet 40. As the user pulls the crossrod rearward, the cover sheet uncoils and extends into a position covering the contents of boat 42. When the user is at a position where he wishes to stop extension, the user cannot let go of crossrod 24. If the user were to let go, the cover sheet 40 would begin to move forward because of the force exerted on the semi-rigid guide member as a result of the torsional force exerted by a torsional spring. The user would need to retain the cover sheet in the extended position by using a retainer such as a pin inserted through one or both of channels 12, 16. Other types of retainers can be used such as a strap, or loop that is fixed to channel 12, 16 or frame structure 50 and can be connected to a crossrod 24. Retraction of cover assembly 10 is then accomplished by releasing the retainer and walking forward in boat 42 while holding a crossrod 24. At the same time, the cover sheet, crossrod, and semi-rigid guide member move forward and coil into a stored position.

In another example, the extension or retraction is not accomplished by manual effort but by a motor connected to drive member 36. In this example, the motor is activated by switch or remote control and the motor causes drive member 36 to rotate. Drive member 36 is able to push semi-rigid guide member 20 in a direction away from the retraction mechanism and into the passage of the channel and cause the attached crossrods and cover sheet to uncoil and move into an extended position. In an opposite mode, the motor can be activated to move the semi-rigid guide member in the opposite direction, towards the retraction mechanism. This action results in the crossrods and attached crossrods to be coiled in a stored position.

The cover assembly 10 as previously described can be configured on a boat or other vehicle in a variety of configurations. In a first example, cover assembly 10 is capable of covering substantially all of a boat. In this example, channels 12, 16 run from the front to the back of the boat but may have intermediate retainers as discussed earlier to provide intermediate locations such that only certain portions of the boat are covered at one time.

Figure 5:
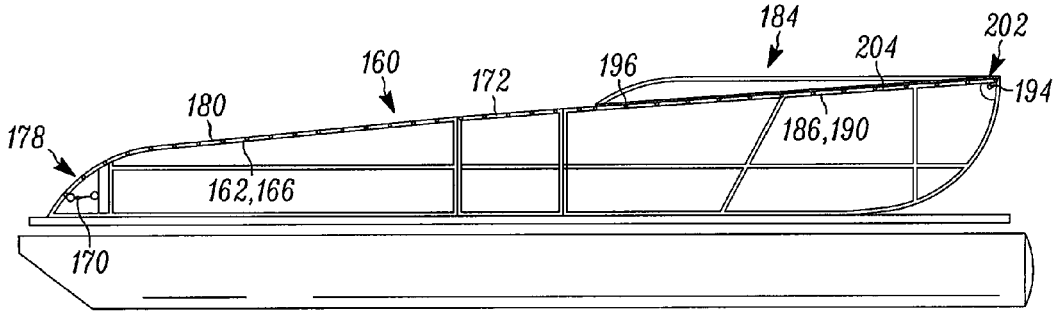
FIG. 5 is a side view of a boat and boat cover assembly according to an example of the present disclosure.

In a second example, a boat contains a first or front cover assembly 160 and a second or rear boat cover assembly 184. In this example, shown in FIG. 5, a front cover assembly 160 includes similar components to those discussed earlier. The front cover assembly 160 includes a pair of channels 162, 166, a semi-rigid guide member 170, crossrods 172, a cover sheet 180, and retraction mechanism 178. The components may include sub-components and configurations as previously disclosed. The front cover assembly can be operated either manually or by mechanical-assist. The front cover assembly 160 may cover only approximately half of the boat.

The second example further includes a rear or second cover assembly 184. The rear cover 184 covers the rear portion of the boat. Rear cover assembly 184 includes a pair of channels 186, 190, rear crossrods 196, a rear cover sheet 204, a semi-rigid guide member 194, and a rear retraction mechanism 202. The rear cover assembly 184 may include sub-components and configurations as previously disclosed. The rear cover assembly 184, in this example, differs from the front cover assembly 160 in that it operates in a direction from rear to front as the cover assembly is extended. The rear cover assembly 184 covers the portion of the boat not covered by the front cover assembly.

Figure 6:
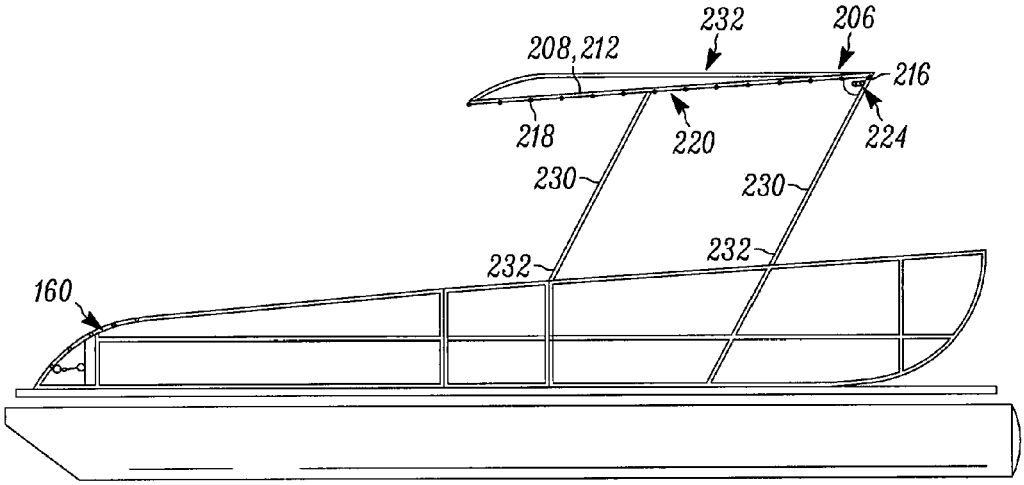
FIG. 6 is a side view of a boat and a rear cover assembly in a raised position according to an example of the present disclosure.

In a third example, the rear cover assembly, as previously described, is capable of operation in lowered or raised position. As shown in raised position in FIG. 6, the rear cover assembly of a third example includes roof frame structure 206. The structure of this cover assembly may be similar to that previously disclosed and may include a pair of channels 208, 212, semi-rigid guide member 216, crossrods 218, cover sheet 220, and retraction mechanism 224. The pair of channels 208, 212 are connected to roof frame structure 206 along with the other components as previously disclosed. In this way, extension or retraction of rear cover assembly 232 can be accomplished manually or via mechanical-assist at either the lowered or raised position. In addition, the rear cover assembly 206 of this example includes support columns 230 that rotate about bottom ends 232 such that the roof frame structure is capable of operation at a lowered or raised position. Support columns 230 and roof frame structure 206 can be made of materials similar to those used to construct a frame structure of a boat such as aluminum, PVC, or coated steel. Other materials can be used as is appreciated by one of ordinary skill in the art.

In any of the preceding examples, the boat can be operated with the cover assembly in an extended position with only part of deck 54 covered by the cover assembly. FIG. 1 shows a boat in such a configuration. Artwork, patterns, logos or other aesthetically pleasing adornments may be added to the external surface of cover sheet 40. In this configuration, the boat has a more pleasing or sporty appearance than that of a boat without such adornments. The artwork may be applied via silk-screening, dyeing, attachment of a patch, or painting but any method known to one of ordinary skill in art may be used.

The preceding detailed description merely sets forth some examples and embodiments of the present disclosure and numerous changes to the disclosed embodiments can be made in accordance with the disclosure herein without departing from its spirit or scope. The preceding description, therefore, is not meant to limit the scope of the disclosure but to provide sufficient disclosure to one of ordinary skill in the art to practice the invention without undue burden.

What is claimed is:

1. A cover assembly on a deck of a boat, comprising:

a first channel having a first passage defined therein;

a second channel having a second passage defined therein;

a semi-rigid guide member slidably disposed within the first passage of said first channel;

a crossrod having a first end and a second end, said crossrod supported on each end by one of said first and second channels, said first end of said crossrod further connected to said semi-rigid guide member such that said crossrod moves in response to movement of said semi-rigid guide member;

a retraction mechanism operably connected to said semi-rigid guide member and adapted to move said semi-rigid guide member through said first passage; and a flexible cover sheet connected to said crossrod, wherein said first and second channels run longitudinally along at least a portion of a length of the boat.

2. The cover assembly of claim 1 wherein said semi-rigid guide member and said first passage are sized such that as a force is applied in a direction generally away from said retraction mechanism, said semi-rigid guide member slides within said first passage.

3. The cover assembly of claim 1 wherein said retraction mechanism further comprises a rotating coil member adapted to coil a length of said semi-rigid guide member when said length of said semi-rigid guide member is not located within said first passage.

4. The cover assembly of claim 3 wherein said rotating member is an axle.

5. The cover assembly of claim 3 wherein said rotating coil member further comprises a torsional spring biasing said rotating coil member such that said rotating coil member tends to resist the uncoiling of said semi-rigid guide member.

6. The cover assembly of claim 1 wherein said retraction mechanism further comprises a rotating drive member engaging said semi-rigid guide member.

7. The cover assembly of claim 6 wherein said rotating drive member is adapted to be connected to a motor such that actuation of the motor results in a rotation of said drive member and movement of said semi-rigid guide member in said first passage.

8. The cover assembly of claim 1 wherein said semi-rigid guide member is a chain.

9. The cover assembly of claim 1 wherein said assembly further comprises a second semi-rigid guide member slidably located in said second passage of said second channel and operably connected to said retraction mechanism, said crossrod further connected to said second semi-rigid guide member.

10. The cover assembly of claim 1 wherein said assembly further comprises a plurality of rotating support columns each having a top end and a bottom end, said top end of each rotating support column connected to one of said first or second channels and adapted for use in a first position and a second position, said first position causing said flexible cover sheet to be located at a first height and said second position causing said flexible cover sheet to be located at a second height, said first height and said second height being different.

11. The cover assembly of claim 1 wherein said assembly further comprises:

a rear pair of channels each having a passage defined therein;

a rear semi-rigid guide member slidably located in the passage of at least one of said rear pair of channels;

a rear crossrod having a primary end and a secondary end, said rear crossrod supported on each end by one of said rear pair of channels, said primary end of rear crossrod connected to said rear semi-rigid guide member such that said rear crossrod moves in response to movement of said rear semi-rigid guide member;

a rear retraction mechanism operably connected to said rear semi-rigid guide member and adapted to move said rear semi-rigid guide member through said passage;

a rear cover sheet connected to at least one rear crossrod of said plurality of rear crossrods;

wherein said flexible cover sheet and said rear cover sheet can move independently of each other.

12. The cover assembly of claim 11 wherein said assembly further comprises a plurality of rotating support columns each having a top end and a bottom end, said top end of each rotating support column connected to one of said rear pair of channels and adapted for use in a first position and a second position, said first position causing said rear cover sheet to be located at a first height and said second position causing said rear cover sheet to be located at a second height, said first height and said second height being different.

13. A boat comprising:

a frame and a cover assembly on a deck of the boat, said frame comprising:

a first channel having a first passage defined therein;

a second channel having a second passage defined therein; and a semi-rigid guide member slidably disposed within the first passage of said first channel; and a retraction mechanism operably connected to said semi-rigid guide member and adapted to move said semi-rigid guide member through said first passage;

said cover assembly comprising:

a crossrod having a first end and a second end, said crossrod supported on each end by one of said first and second channels, said first end of said crossrod further connected to said semi-rigid guide member such that said crossrod moves in response to movement of said semi-rigid guide member; and a flexible cover sheet connected to said crossrod.

14. A boat comprising a deck, a frame structure, and a cover assembly;

said frame structure attached to said deck and comprising a support system and a first channel and a second channel; said support system attached to said first and second channel and disposing said first and second channels at a predetermined distance from each other; said first channel having a first passage defined therein and said second channel having a second passage defined therein;

said cover assembly operably interacts with said frame structure, said cover assembly comprising a flexible cover sheet, a semi-rigid guide member, a crossrod; and a retraction mechanism, said semi-rigid guide member slidably disposed within said first passage and attached to said retraction mechanism, said crossrod spanning said predetermined distance between said first and second channel and comprising a first end and a second end, said first end attached to said semi- rigid guide member, said flexible cover sheet attached to said crossrod;

wherein said flexible cover sheet, said crossrod, said semi-rigid guide member, and said retraction mechanism all move to enable said flexible cover sheet to cover or uncover a portion of said deck.

* * * * *